US005299111A

United States Patent [19]

Parduhn et al.

[11] Patent Number: 5,299,111

[45] Date of Patent: Mar. 29, 1994

[54] DEVICE FOR DIRECTING A BEAM OF LIGHT

[76] Inventors: A. Philip Parduhn, 14501 Wilson Rd., Edmond, Okla. 73013; Michael N. Fiske, 4259 Crestline Rd., Ft. Worth, Tex. 76107; John D. Schmidt, 7151 Hudson Cemetery Rd., Manfield, Tex. 76063

[21] Appl. No.: 758,853

[22] Filed: Sep. 12, 1991

Related U.S. Application Data

[63] Continuation-in-part of Ser. No. 580,701, Sep. 11, 1990, abandoned.

[51] Int. Cl.[5] ..... F21V 11/02

[52] U.S. Cl. ..... 362/290; 362/354; 362/359

[58] Field of Search ..... 362/354, 290, 376, 268, 362/359, 362, 342, 298, 301

[56] References Cited

U.S. PATENT DOCUMENTS

| | | |
|---|---|---|
| 1,236,137 | 8/1917 | Bastow . |
| 1,594,004 | 7/1926 | Diesel . |
| 1,675,767 | 7/1928 | Rich et al. . |
| 2,182,987 | 12/1939 | Hopkins . |
| 2,380,691 | 7/1945 | Gross . |
| 2,540,389 | 2/1951 | Fowler . |
| 3,405,262 | 10/1968 | Dolan et al. . |
| 3,751,658 | 8/1973 | Arnold . |
| 3,863,251 | 1/1975 | Gould et al. . |
| 4,158,222 | 6/1979 | Cook . |
| 4,214,168 | 7/1980 | Kulka . |
| 4,689,728 | 8/1987 | Yamai et al. . |

FOREIGN PATENT DOCUMENTS

| | | |
|---|---|---|
| 531610 | 1/1992 | France . |
| 9949 | of 1914 | United Kingdom . |
| 551212 | 2/1943 | United Kingdom . |
| 565548 | 11/1944 | United Kingdom . |

OTHER PUBLICATIONS

Photographs of prototype used in a 1989 trade show.

*Primary Examiner*—Richard R. Cole

*Attorney, Agent, or Firm*—Dunlap, Codding & Lee

[57] ABSTRACT

A device for directing a beam of light from a light source to a predetermined view range. The device is particularly suitable for installation inside the visor of a traffic signal, although other applications will be apparent. Two or more baffles are selectively positioned within a hollow housing. The baffles are uniformly formed and each has a plurality of apertures. The baffles are thin plates and are aligned so that each set of corresponding apertures creates a tunnel for a portion of a beam of light from the light source. Due to the thinness of the baffles, the "tunnels" have no walls and no substantial surface area to deflect light rays outside the selected view range. This provides a sharp on-off effect at the periphery of the view range. Yet, a "full ball" effect is provided within the view range. The exterior of the housing is contoured to fit inside the visor so that the position of the device, and therefore the direction of the light beam, may be adjusted by multi-directional rotation within the visor.

50 Claims, 8 Drawing Sheets

DEVICE FOR DIRECTING A BEAM OF LIGHT

This application is a continuation-in-part of prior application Ser. No. 07/580,701, for "A Device For Directing a Beam of Light," filed Sep. 11, 1990 now abandoned.

FIELD OF THE INVENTION

The present invention relates generally to devices for directing beams of light and, more particularly, to such devices adapted for use with traffic signals.

SUMMARY OF THE INVENTION

The present invention comprises a device for directing a beam of light from a light source. The device comprises a hollow housing having a open first end and an open second end parallel to the first end. The interior of the housing defines a channel between the first end and the second end. At least a portion of the outer contour of the housing is spherical.

The device further comprises a plurality of spaced apart baffles supported in the channel of the housing. Each baffle comprises an opaque plate with a plurality of apertures. The baffles are positioned parallel to each other and to the first and second ends of the channel. The apertures in the baffles are aligned so as to permit a portion of the light from the light source to pass through the channel, so that the beam of light from the light source is directed to a preselected view range.

The present invention further comprises a device for directing a beam of light from a light source. The device comprises a hollow housing having a open first end and an open second end parallel to the first end. The interior of the housing defines a channel between the first end and the second end. The housing is adapted for supporting the device in the path of the beam of light so that a major portion of the light beam is directed into the channel in the housing.

The device further comprises a plurality of baffles removably supported in the channel of the housing. Each baffle comprises an opaque plate with a plurality of apertures. The baffles are positioned parallel to each other and to the first and second ends of the channel. The apertures in the baffles are aligned so as to permit a portion of the light from the light source to pass through the channel. Means is included in the housing for supporting the baffles in multiple parallel positions throughout the length of the channel, whereby the positions of the baffles in the channel are adjustable.

Still further, present invention includes a device for directing a beam of light from a light source. The device comprises a hollow housing having a open first end and an open second end parallel to the first end. The interior of the housing defines a channel between the first end and the second end, and the housing is adapted for supporting the device in the path of the beam of light so that a major portion of the light beam is directed into the channel in the housing.

A plurality of baffles is supported in the channel of the housing. Each baffle comprises an opaque plate with a plurality of apertures. The baffles are positioned parallel to each other and to the first and second ends of the channel. The apertures in the baffles are aligned so as to permit a portion of the light beam from the light source to pass through the channel The plurality of baffles includes a front baffle supported in the housing and a rear baffle supported in the housing between the front baffle and the light source. The distance between the front baffle and the rear baffle is selected to produce a predetermined view angle. The plurality of baffles also includes at least a first intermediate baffle supported in the housing between the front baffle and the rear baffle. The position of the intermediate baffle is selected to prevent light which passes through aligned apertures in the front and rear baffles from being seen through non-aligned apertures in the front baffle.

Still further, the present invention comprises a device for directing a beam of light from a light source. The device comprises a hollow housing having a open first end and an open second end parallel to the first end. The interior of the housing defines a channel between the first end and the second end. At least a portion of the outer contour of the housing is spherical, and the outer surface of the housing defines two circumferential grooves which are parallel to the open first end and to each other. Two rings of resilient material are included, one seated in each of the grooves in the outer contour of the housing.

A plurality of baffles is removably supported in the channel of the housing, each baffle comprising an opaque plate with a plurality of apertures. The baffles are positioned parallel to each other and to the first open end of the channel. The apertures in the baffles are aligned so as to permit a portion of the light beam from the light source to pass through the channel.

The plurality of baffles includes a front baffle supported in the housing and a rear baffle supported in the housing between the front baffle and the light source. The distance between the front baffle and the rear baffle is selected to produce a predetermined view angle.

The plurality of baffles further includes at least a first intermediate baffle supported in the housing between the front baffle and the rear baffle. The position of the intermediate baffle is selected to prevent light which passes through aligned apertures in the front and rear baffles from being seen through non-aligned apertures in the front baffle.

The device includes means in the housing for supporting the baffles in multiple parallel positions throughout the length of the channel. In this way, the positions of the baffles in the channel are adjustable.

Still further, the present invention includes an assembly for directing a beam of light from a light source. The assembly comprises a visor sized for capturing the light beam from the light source and means for attaching the visor adjacent the light source. The assembly includes a device in accordance with the invention as described above.

Still further, the invention comprises a traffic signal including a signal head, a light source mounted in the signal head and a visor on the signal head extending from the light source. The traffic signal includes a device for directing the beam of light from the light source, in accordance with the invention described above.

DETAILED DESCRIPTION OF THE PREFERRED EMBODIMENTS

To promote traffic safety, it sometimes is necessary to control or limit the area from which a traffic signal light can be seen by drivers or pedestrians. For example, the light from a left turn signal should be limited laterally so that it is visible only to drivers in the left turn lane. This eliminates the hazards which otherwise result when drivers of vehicles in the adjacent through lanes are distracted or confused by the operation of the signal in the left turn lane.

The present invention provides a device for directing the beam of light from a traffic signal so that it can be seen only from vehicles within a selected view range. As used herein, "view range" denotes a three dimensional area from which a light can be seen. In particular, the device of this invention provides a view range with a sharp on-off point. That is, when the viewer moves from a position immediately inside the view range to a position immediately outside the view range, the light appears to turn off instantly. Likewise, when the viewer moves back into the view range, the light appears to turn on suddenly. Yet, from any position within the view range, the entire light or a "full ball" is seen; the viewer does not see gradually increasing sections of the ball of light as he moves deeper into the view range.

As will become apparent, the device of this invention is inexpensive to manufacture and to maintain and can be installed conveniently in virtually any existing signal apparatus. Further features and advantages will be apparent from the following description.

Figure 1:
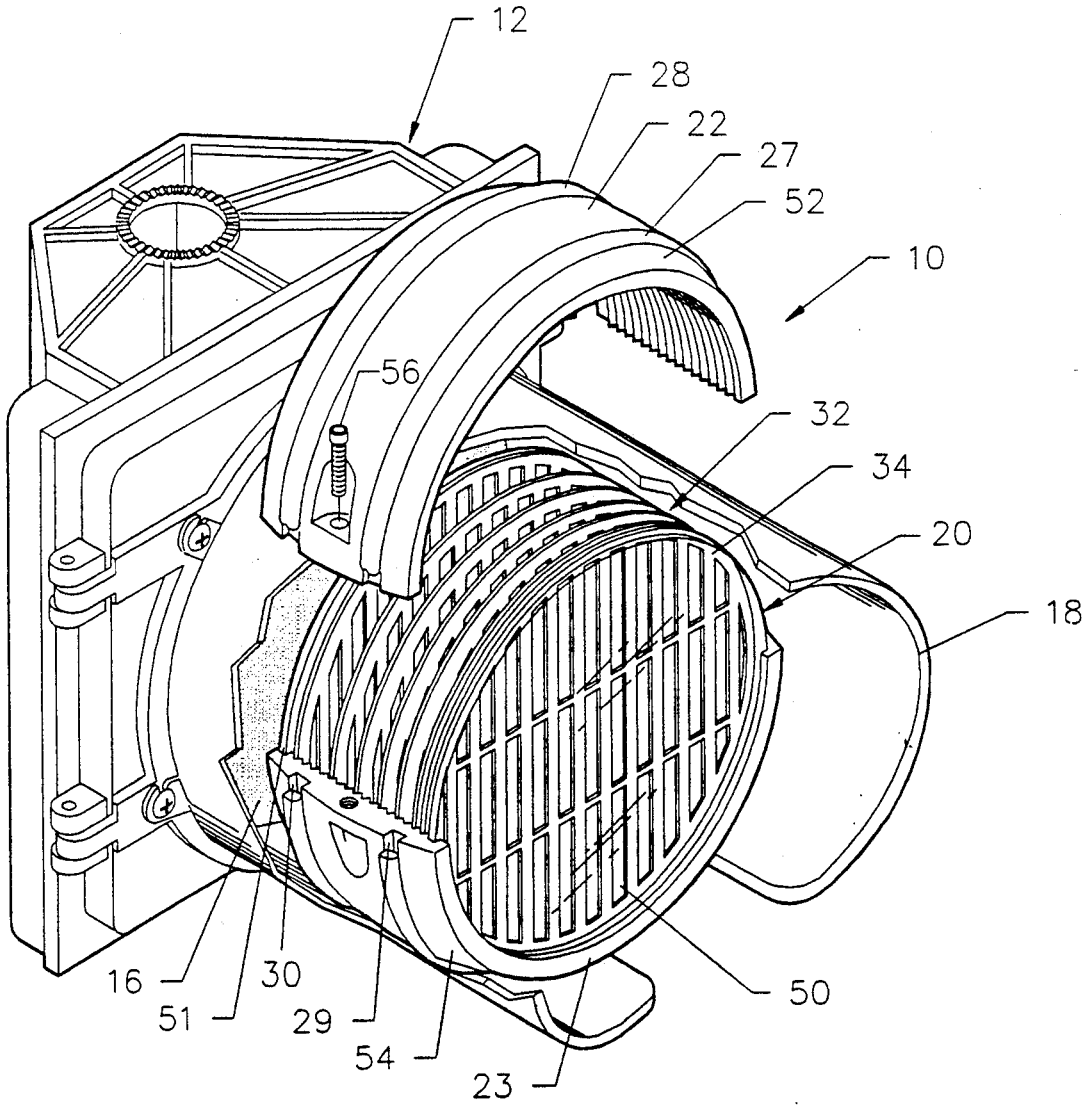
FIG. 1 is a partially exploded, perspective view of a traffic signal in which is installed a light directing device according to the present invention.
Figure 2:
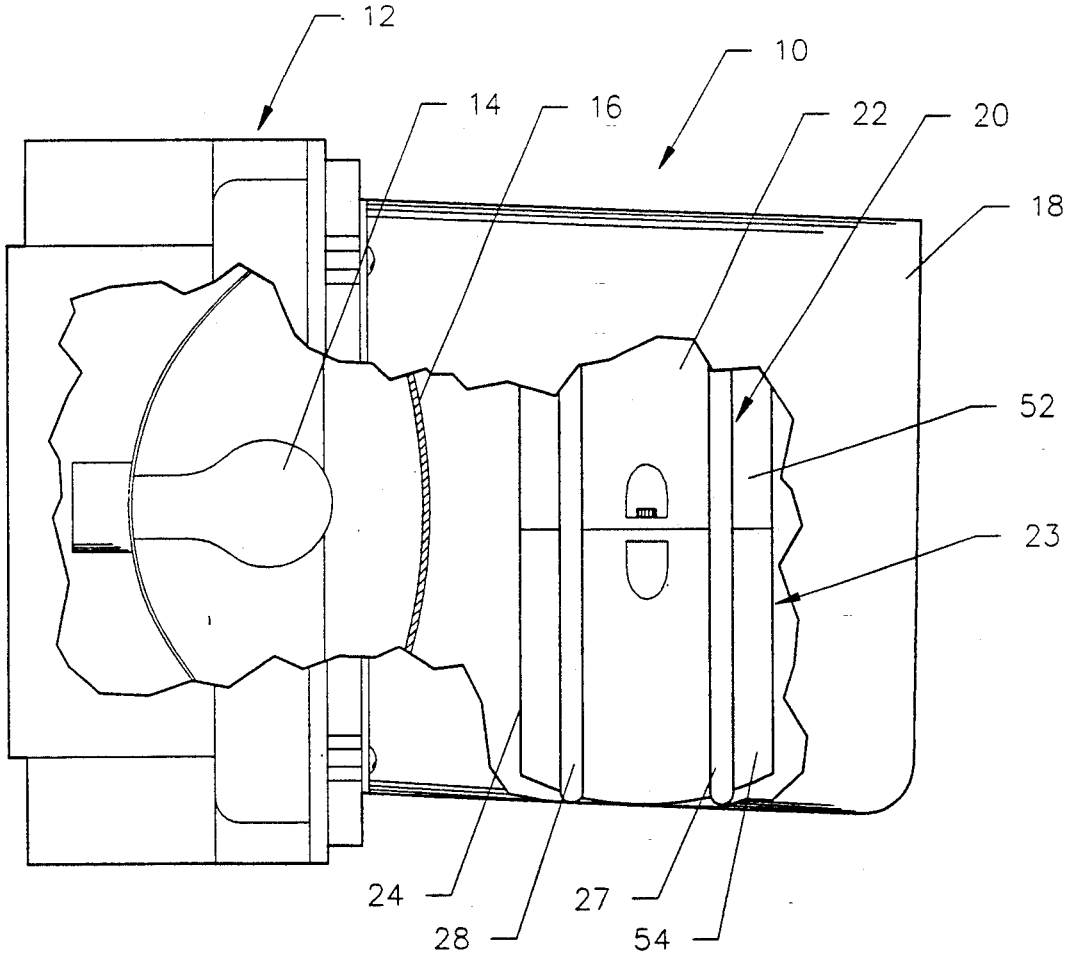
FIG. 2 is side elevational view of the traffic signal shown in FIG. 1.

With reference now to the drawings in general and to FIGS. 1 and 2 in particular, there is shown therein a traffic signal designated generally by the reference numeral 10. The traffic signal 10 is illustrative of conventional signal devices typically comprising a signal head 12 which supports one or more sources of light, such as the light bulb 14 (FIG. 2 only). The bulb 14 usually is covered by a colored lens 16, and a visor 18 extends from the signal head in front of the lens 16.

In accordance with the present invention, the traffic signal 10 is equipped with a device 20 for directing the beam of light from the light bulb 14 in the traffic signal 10. As best seen in the partially exploded view of FIG. 1, the light directing device 20 comprises a hollow housing 22. The exterior of the housing 22 is shaped so as to fit within the visor 18 of the traffic signal 10. This provides a device which can be installed in existing traffic signals without modifying the visor or the signal head.

Many traffic signal visors are cylindrical, as shown in FIGS. 1 and 2. However, some visors are square. Whether the visor is round or square, the exterior of the housing 22 preferably is curved. More preferably, in longitudinal cross-section, the outer contour of the housing defines an arc of a circle so that the outer contour of the housing forms part of a sphere. Having this shape, the housing can be rotated in any direction inside a tubular visor regardless of the cross-sectional shape of the visor.

The maximum diameter of the housing 22 is selected according to the internal dimensions of the visor 18. The housing 22 should fit snugly in the visor 18 and yet permit, without undue friction, multi-directional rotation of the housing within the visor. In this way, the position of the housing 22 within the visor 18 is adjusted easily. Sheet metal screws or the like (not shown) can be used to secure the housing 22 inside the visor 18 in the selected position.

Figure 4:
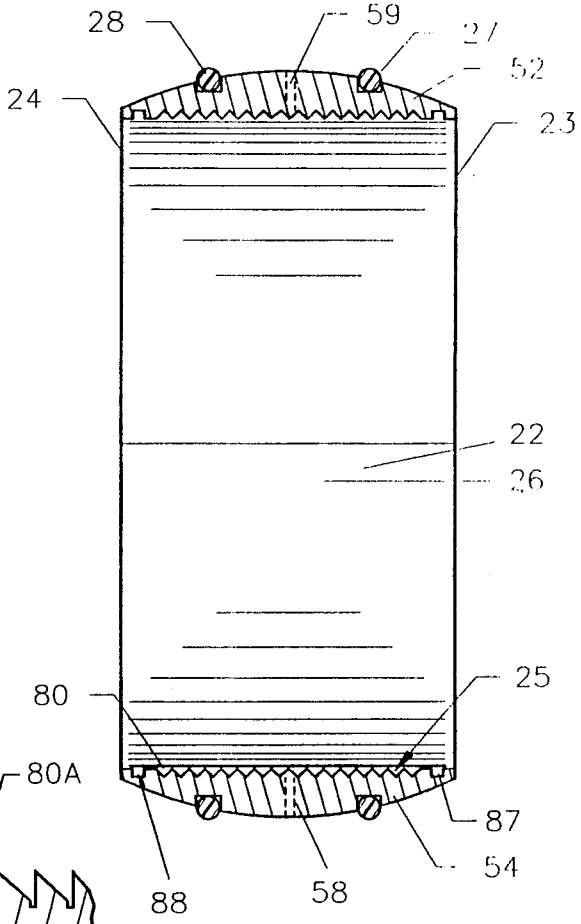
FIG. 4 is a sectional view of the housing taken along the line 4—4 in FIG. 3.
Figure 3:
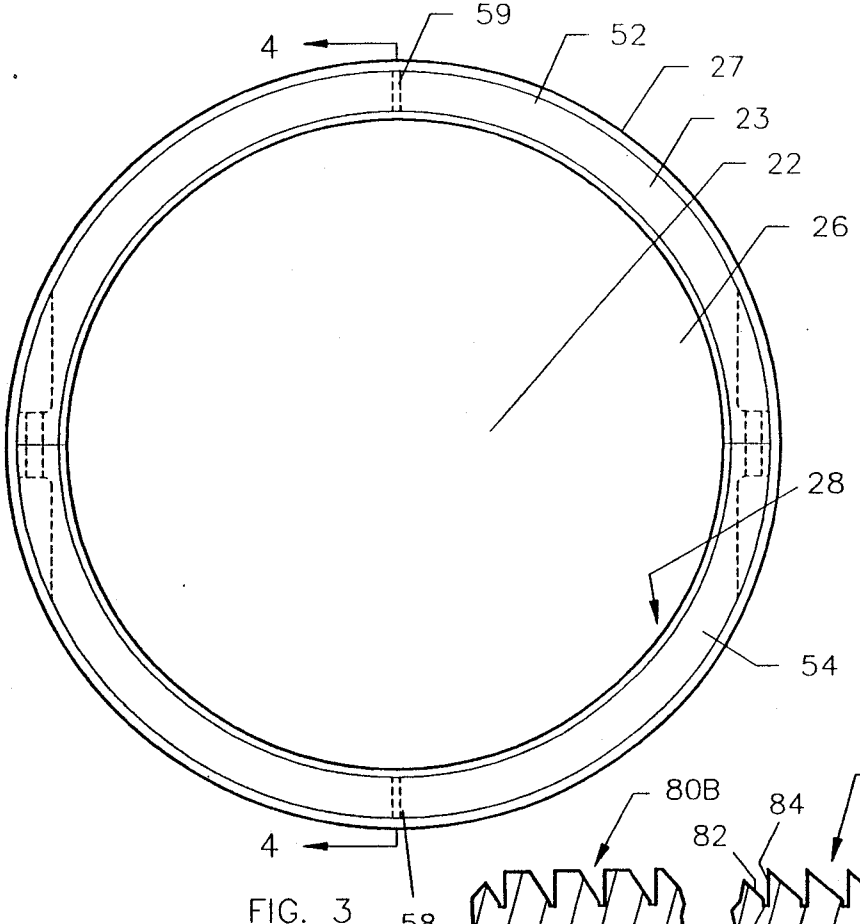
FIG. 3 is an end elevational view of the housing of the light directing device.

With continuing reference to FIGS. 1 and 2 and now also to FIGS. 3 and 4, the housing 22 has an open first or front end 23 and an open second or rear end 24 parallel to the open first end. The inner wall 25 of the housing 22 forms a channel 26 between the first and second ends 23 and 24. Preferably, the diameter of the channel 26 is about the same diameter as the lens 16 and the beam of light from the light source 14 transmitted therethrough. In this way, at least a major portion and preferably substantially all of the light beam is directed into the channel 26. The depth of the housing 22, or the distance between the first and second open ends 23 and 24, depends on the desired maximum distance between the front and rear baffles, as described later.

As is also shown in FIGS. 1, 2 and 4, the housing 22 preferably is provided with front and rear O-rings 27 and 28 which are positioned in circumferential grooves or seats 29 and 30. The O-rings 27 and 28 may be made of sponge rubber or some other water resistant, resilient material. The O-rings 27 and 28 provide a light seal between the outer wall of the housing 22 and the inner wall of the visor 18.

Figure 5:
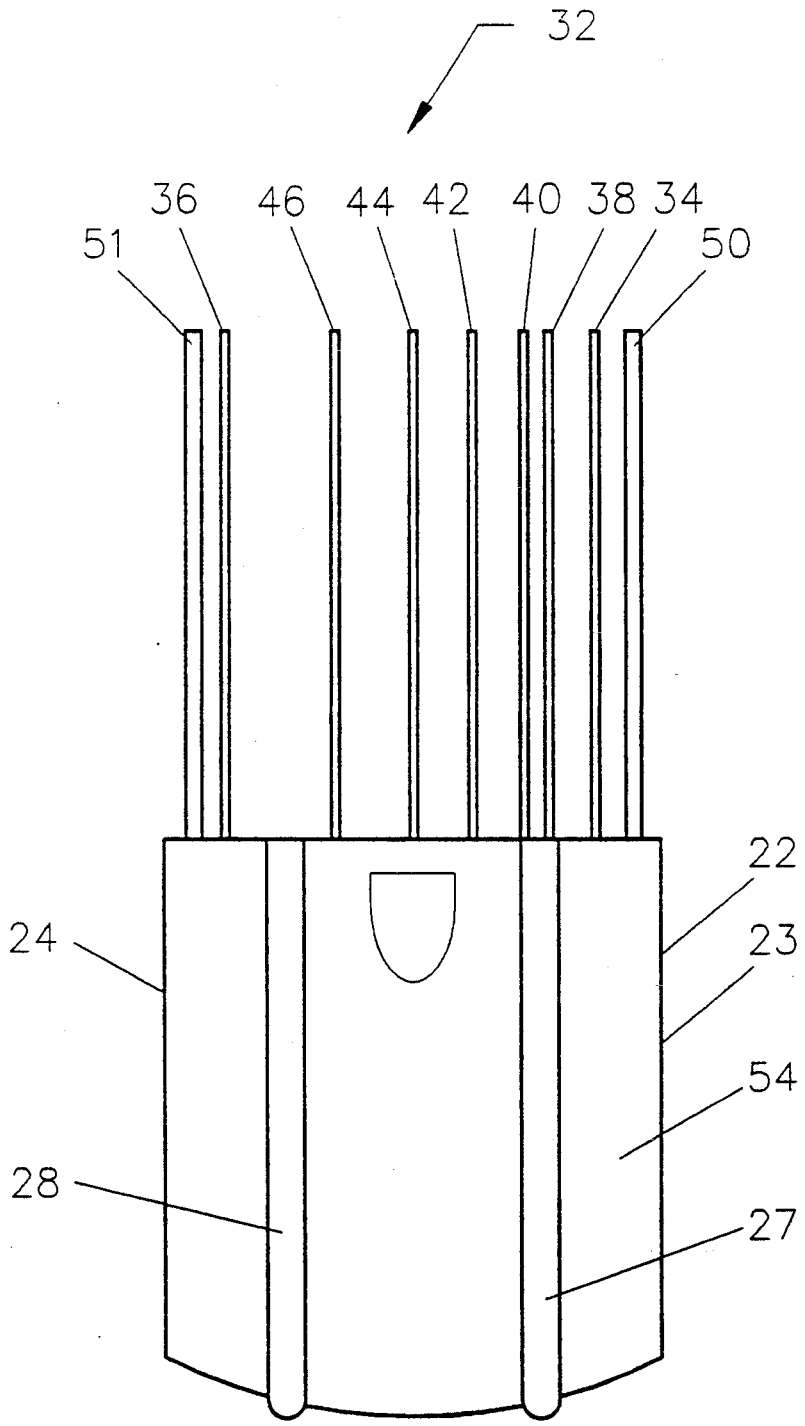
FIG. 5 is a side elevational view of the device of the present invention with the top half of the housing removed showing the positions of the cover plates and the baffles.

As best shown in FIG. 5, two or more spaced apart baffles, referred to herein collectively by the reference numeral 32, are supported in the housing 22. Preferably, the device 20 includes at least five but less than ten baffles. Most preferably, the device 20 has a front baffle 34, a rear baffle 36 and five intermediate baffles 38, 40, 42, 44 and 46, positioned as shown in FIG. 5. The relative distances between the baffles is determined in a manner which is described hereafter.

It will be appreciated that, due to the configuration of the housing 22, there may be a tendency for debris to collect in it. Birds may attempt to nest inside the housing 22. Similarly, blowing leaves, snow and the like may collect inside the housing 22.

For preventing the accumulation of such obstructive matter in the housing 22, at least one transparent cover plate is included. Preferably, a front cover plate 50 is positioned at the front of the housing 22 immediately behind the open first end 23 and in front of the front baffle 34. A second or rear cover plate 51 may be inserted at the rear of the housing 22.

Preferably, the cover plates 50 and 51 (FIG. 1-2) are about the same size and shape as the baffles 32 and are supported in the housing in a similar manner. The cover plates 50 and 51 should be of some non-breakable material which will not cause significant refraction of the light beam from the bulb 14. One suitable material is polycarbonate.

With continued reference to FIGS. 1-5, to permit the placement, and repositioning if necessary, of the baffles 32 in the housing 22, the housing is formed in two symmetrical halves 52 and 54. The halves 52 and 54 can be joined by countersunk bolts 56 (FIG. 1) or some like means. Drainage ports 58 and 59 (FIG. 3-4) are provided in the halves 52 and 54 of the housing 22 for preventing the accumulation of fluid, such as rainwater, in the housing.

Figures 7, 8, 9, 10, 11:
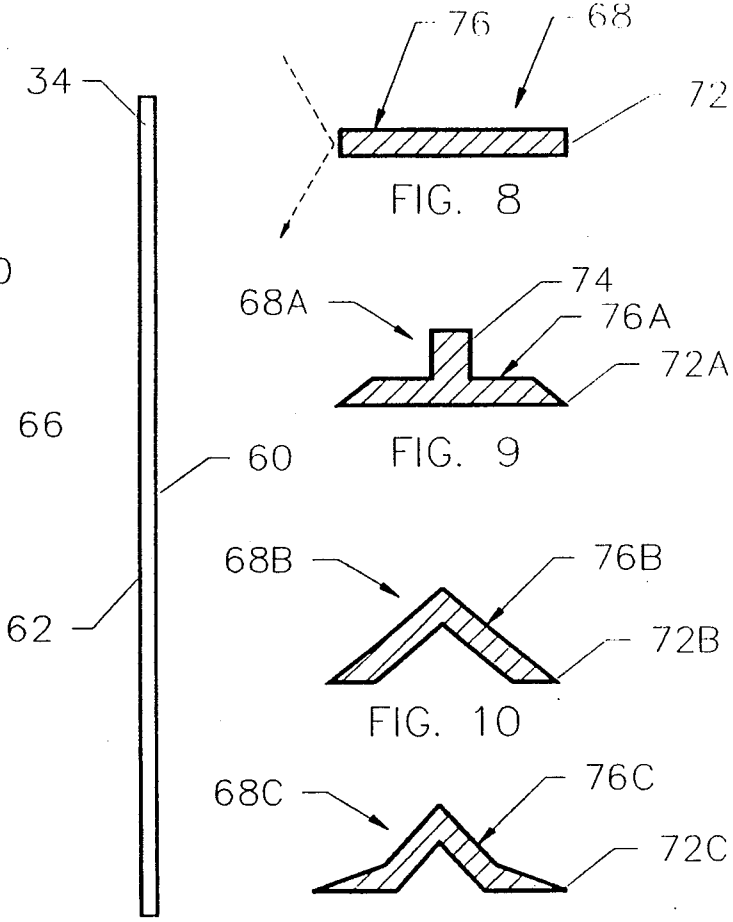
FIG. 7 is a side elevational view of the baffle shown in FIG. 6.
FIG. 8 is an enlarged, horizontal sectional view of one of the strips forming the baffle shown in FIG. 7.
FIG. 9 is an enlarged, horizontal sectional view of a baffle strip having an alternate configuration.
FIG. 10 is an enlarged, horizontal sectional view of a strip having another alternate configuration.
FIG. 11 is an enlarged, horizontal sectional view of a strip having yet another alternate configuration.
Figure 6:
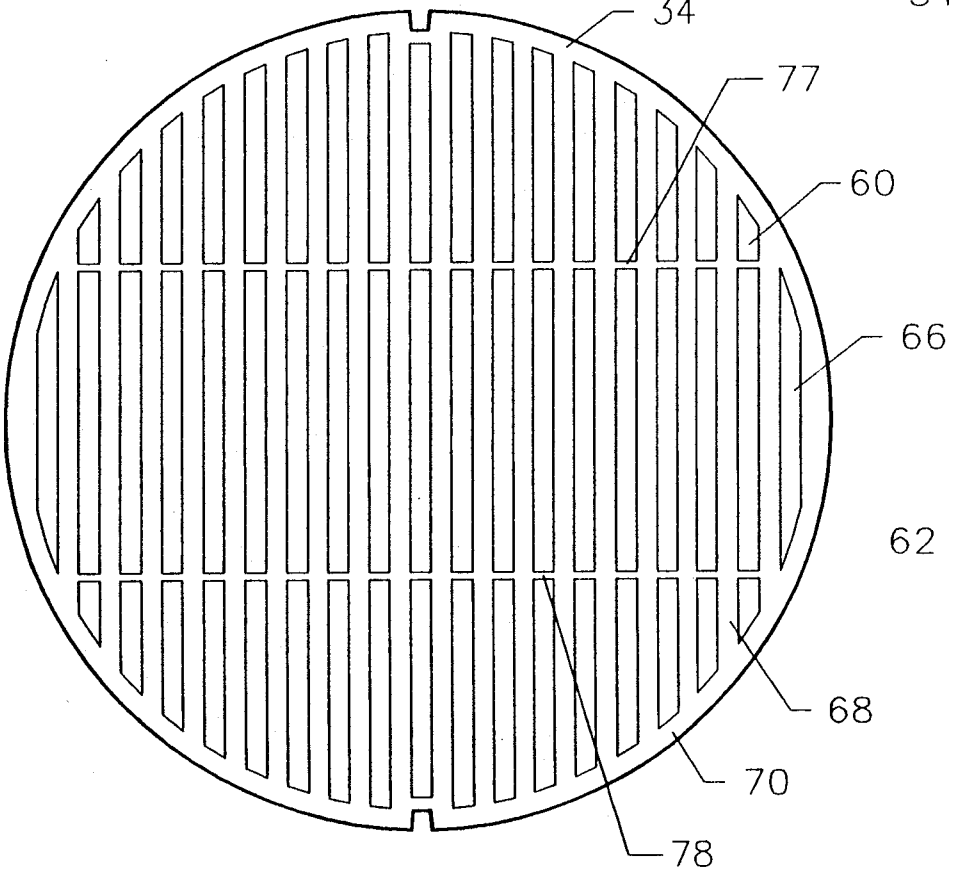
FIG. 6 is a front elevational view of a baffle which forms part of the light directing device of the present invention.

A preferred form of the front baffle 34 is shown in FIGS. 6 and 7. As all the baffles should be similarly formed, only the front baffle 34 will be described in detail herein. The baffle 34 has a front face 60 and rear face 62 and is provided with a plurality of apertures.

The apertures may take any of a variety of shapes and sizes, including but not limited to circular, rectangular or square holes and elongate slots. Because substantially all the light from the signal 10 is seen through the apertures in the device 20, the size, shape and spatial relationship of the apertures determine in part the shape of the light beam from the traffic signal and how much light is allowed to pass through the device 20.

In the preferred embodiment, the apertures take the form of slots 66 defined by parallel strips 68 extending substantially the width of the baffle 34 in one direction. The peripheral portion 70 of the baffle 34 preferably is solid. This adds rigidity to the baffle 34 and provides a means by which the baffle can be mounted in the housing 22, as will be described hereafter.

The baffle 34 preferably is completely flat, as depicted (also enlarged) in FIGS. 6 and 7. In this instance, the strips 68, and therefore the baffle, should be thin, that is, less than 0.10 and more preferably less than 0.030 inches in thickness. (In FIG. 7, the thickness is exaggerated for purposes of illustration.) This is advisable because the flat edges 72 of the strips 68, seen in FIG. 8, if large enough, can cause significant deflection of the light rays, as indicated by the path of the arrow in FIG. 8.

As used herein, "deflection" refers to reflection of a ray of light at an angle which directs the ray outside the selected view range. Deflected rays, seen from outside the view range, create an undesirable glowing effect. This results in a less distinct on-off point at the periphery of the view range.

Alternate configurations of the strips 68 are shown in FIGS. 9-11. FIG. 9 depicts a strip 68A which has an inverted T-shape in cross section. The vertical portion 74 of the "T", which extends toward the light bulb 14, forms a reinforcing spine on the rear face 76 of the strip. FIG. 10 depicts a strip 68B, which has a V-shape in cross-section. The inner angle of the "V" can be oriented toward or away from the light bulb 14. FIG. 11 depicts a modified V-shaped strip 68C, wherein the branches of the "V" are angled.

In each of the alternate configurations, the strips 68A, 68B and 68C have an overall thickness greater than the thickness of the strip shown in FIG. 8. This provides a more rigid, sturdy baffle and one which can easily be formed by conventional pressing methods. For additional strength, the baffles 32 can be provided with one or more intersecting strips 77 and 78.

Yet, like the strip 68 (FIG. 8), none of these strips has an edge with an area large enough to cause significant deflection. Rather, in each of the embodiments, the edges 72A, 72B and 72C of the strips (FIG. 8-10) are substantially pointed. All facets of the rear faces 76A, 76B and 76C of the strips 68A, 68B and 68C are angled so that any light ray which impacts the rear face will be reflected back into the housing 22, as shown by the arrows. The "glow" effect is thereby minimized.

As indicated, when the signal light 10 is viewed from a distance within the predetermined view range, the light appears as a full ball. The strips 68 in the baffles 32 are not visible except within close range of the signal. It is known in the optics art that light rays tend to "bend" around an object in their path. Although not wishing to be bound by theory, it is believed that this optical phenomenon causes the multiple strips in the baffles to be invisible from a distance.

On the other hand, the number and spacing of the strips affect their visibility. For example, a single strip running horizontally across the vertical strips 68 is quite visible, even at substantial distances. This phenomenon can be applied advantageously to create indicia on the light. Accordingly, a directional arrow could be imposed by shaping the baffles appropriately.

The baffles 32 may be formed of any suitably rigid material. The material selected also should be noncorrosive. The method of making the baffles 32 will, of course, depend on the material used. For example, where metal is used, the baffle may be economically formed by mechanical pressing methods. Alternately, a plastic baffle may be formed by injection molding techniques.

The surface of the baffle should be nonreflective. If the material of which the baffles are formed does not provide this effect, flat black paint may be applied.

Referring still to FIGS. 1-6, the baffles 32 are supported in the housing 22 parallel to the first and second ends 23 and 24 of the housing and parallel to each other. For supporting the baffles 32 and the cover plates 50 and 51 (FIG. 5) in the housing 22, the inner wall 28 of the housing preferably is provided with a number of circumferential grooves 80, best seen FIG. 4. Each groove 80 is sized to receive the peripheral portion 70 (FIG. 6) of a single baffle 32 and may be substantially V-shaped.

Figure 12:
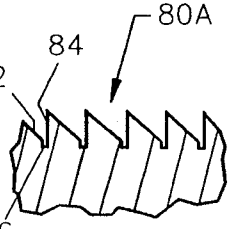
FIG. 12 is an enlarged view of a section of the inner wall of the housing shown in FIG. 4 showing an alternate configuration of the grooves in the wall.

Turning now to FIG. 12, there is shown therein an alternate groove configuration. In this configuration, which is enlarged for ease of illustration, each groove 80A is defined at least in part by a front surface 82 and a rear surface 84. The front surface 82 defines a plane parallel to the first and second ends 23 and 24 of the housing 22. The front surface 82 of the groove 80A is shaped so as to engage the baffle 32 by closely conforming to the peripheral portion 70 of the front face 60 of the baffle (FIGS. 6 and 7). This minimizes the possibility of deflection of light rays off the front surface 84 of the groove 80A.

The bottom 86 of the groove is shaped to conform to the edge of the baffle 32. The rear surface 84 of the groove 80A is angled outwardly from the front surface 82. This permits easy placement and repositioning of the baffle 32 in the groove.

Figure 13:
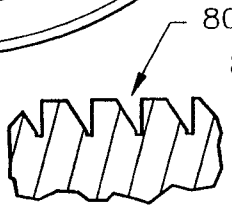
FIG. 13 is an enlarged view of a section of the inner wall of the housing shown in FIG. 4 showing a second alternate configuration of the grooves in the wall.

In FIG. 13 there is shown an enlargement of another preferred groove configuration 80B. The groove 80B is similar to the groove 80A (FIG. 12). However, in this embodiment of the invention, the grooves are spaced a distance apart.

In the preferred embodiment (FIG. 4), a large number of grooves 80 is provided in the inner wall 28. This provides an inner wall 25 of the housing 22 which has no significant surface area parallel to the plane of the direction of the light rays, which could deflect light rays outside the predetermined view angle.

Moreover, multiple grooves in the inner wall 25 permit the position of each of the baffles 32 in the housing 22 to be adjusted easily by separating the halves 52 and 54 and moving the baffle from one groove to another. Still further, the production of light directing devices of this invention is simplified in that a single housing design can be utilized with different baffle positions, thus providing a device which is capable of producing a variety of predetermined view ranges.

As indicated, the cover plates 50 and 51 (FIG. 5) are supported in the housing 22. It is preferred to provide squared grooves 87 and 88 in the inner wall 25 of the housing 22 to receive the cover plates 50 and 51, as shown in FIG. 4.

As indicated, the relative positions of the baffles 32 within the housing 22 control the view range of the light beam from the traffic signal 10. The baffles 32 preferably are identically formed. Thus, when the baffles are parallel and rotated within the housing 22 so that corresponding apertures are aligned, each set of corresponding apertures in the series of parallel baffles forms a sort of wall-less tunnel through which a portion of the light rays passes.

Figure 14:
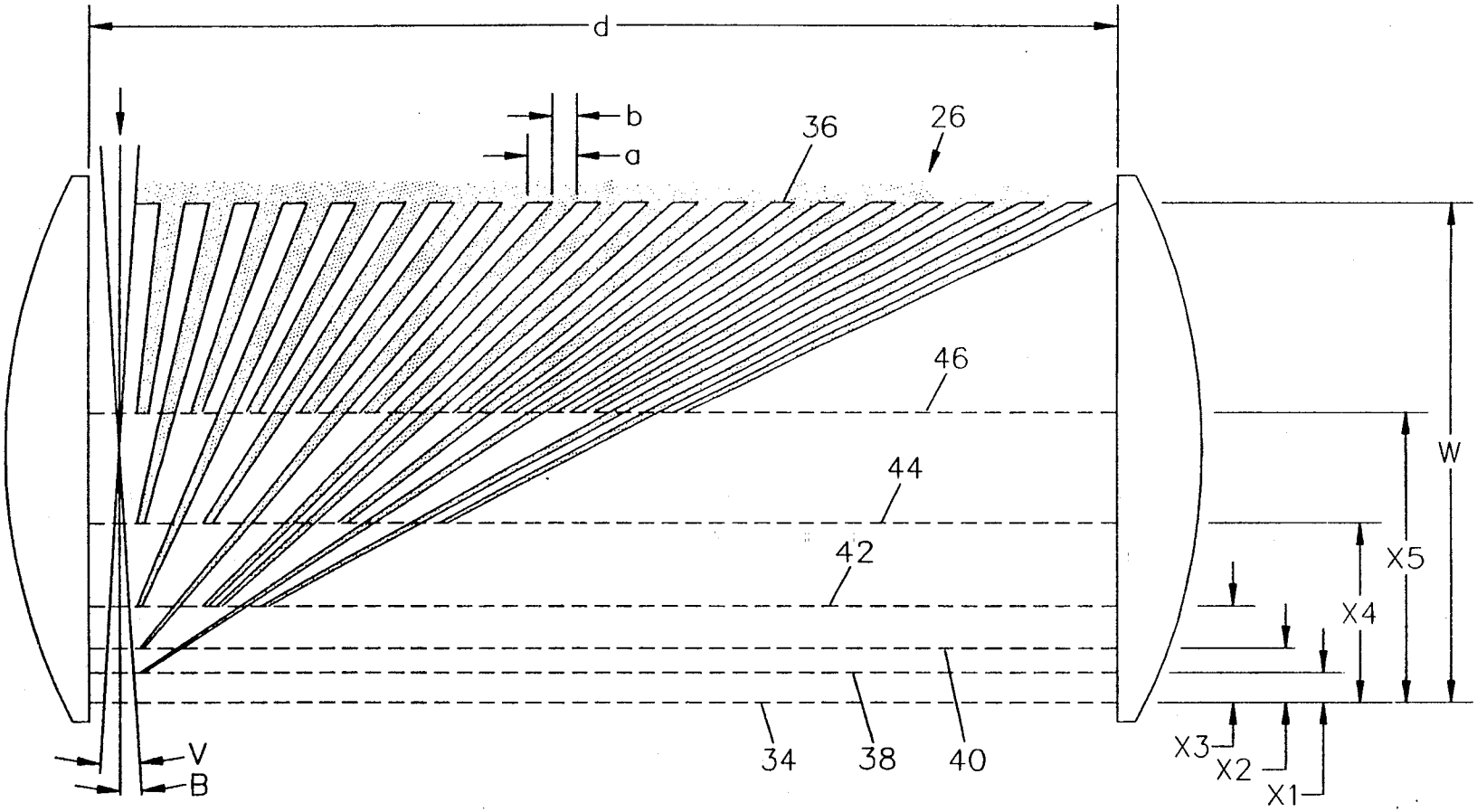
FIG. 14 is a schematic representation of the tunnel effect created by the relative positions of the baffles in the light directing device of this invention.

Turning now to FIG. 14, the horizontal plane of the view range created by the baffles of the preferred embodiment is depicted schematically. Rays of light, indicated by dot-dash lines, from the light source (not shown) pass through a series of apertures in the baffles 34, 36, 38, 40, 42, 44 and 46. The lateral diameter of the light beam exiting the front baffle 34 constitutes the view angle "V".

"View angle" is the width in one plane of the view range. In most instances, the view angle of interest will be the lateral dimension or width of the light beam horizontal to the ground, and this is the view angle depicted in the schematic plan view of FIG. 14. However, as discussed elsewhere, in some instances the vertical view angle will be of most importance.

As depicted in FIG. 14, the distance "w" between the front and rear baffles 34 and 36 controls the width "V" of the view angle. The symbol "$\beta$" denotes the half angle. The greater the width "w", the narrower the view angle "V". Accordingly, once the desired view angle is determined, the front and rear baffles 34 and 36 are positioned in the housing 22 at the appropriate distance.

This distance between the front and rear baffle may be calculated as follows:

$$\beta = \arctan\left[\frac{b}{w}\right]$$

where "b" is the lateral dimension of the aperture.

A view angle of 7 degrees has been found suitable for a left turn signal light. Thus, to produce this view angle, where the apertures are 0.25 inches wide, the front and rear baffles 34 and 36 are positioned about 4 inches apart in the housing 22. (See Table I below.)

Now it will be understood that when the apertures in the baffles are elongate slots, as described herein, the width of the slots determine the width of the corresponding horizontal view angle. Accordingly, rotation of the housing 22 about 90 degrees, so that the slots are oriented horizontally instead of vertically as shown in the drawings, produces a view angle in a horizontal plane instead of vertical plane. In the vertical plane, the view angle controls the distance at which the light can first be seen and the distance, approaching the light, at which the light no longer can be seen.

Figure 15:
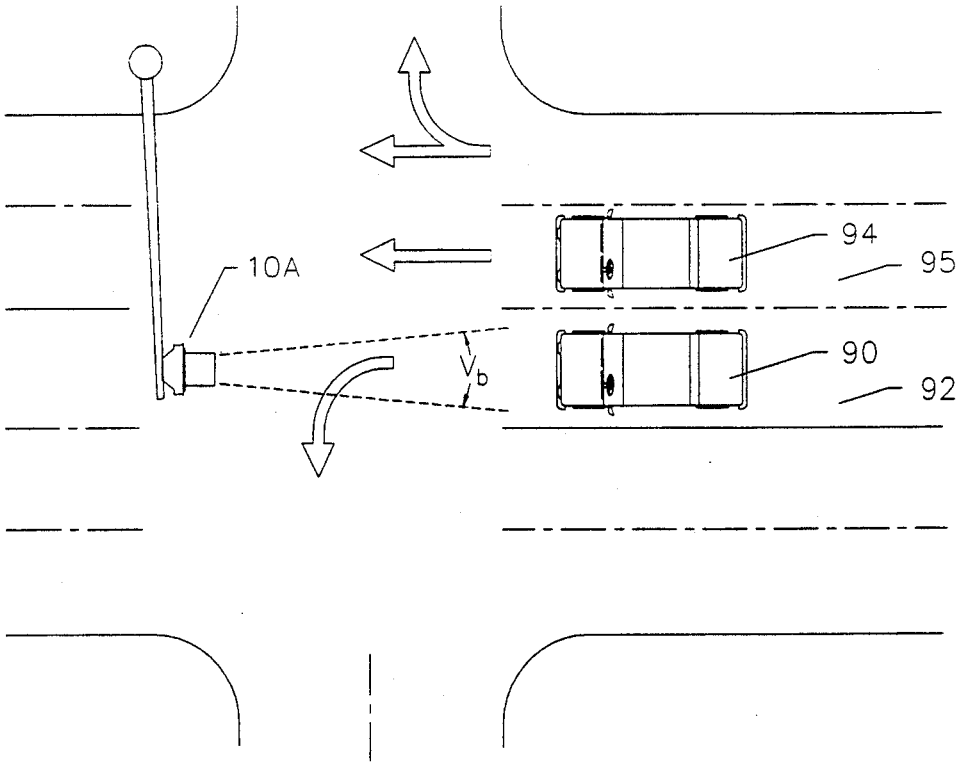
FIG. 15 is a schematic representation of a signal light at an intersection depicting a view range laterally limited to the left turn lane.

As depicted in FIG. 15, the horizontal view angle is useful for limiting the view range of the light to the lane which the traffic signal controls. For example, the horizontal view angle "$V_h$" would permit the signal light 10A to be seen by a vehicle 90 in the left turn lane 92, but would prevent the light from being seen by a vehicle 94 in the adjacent through lane 95.

Figure 16:
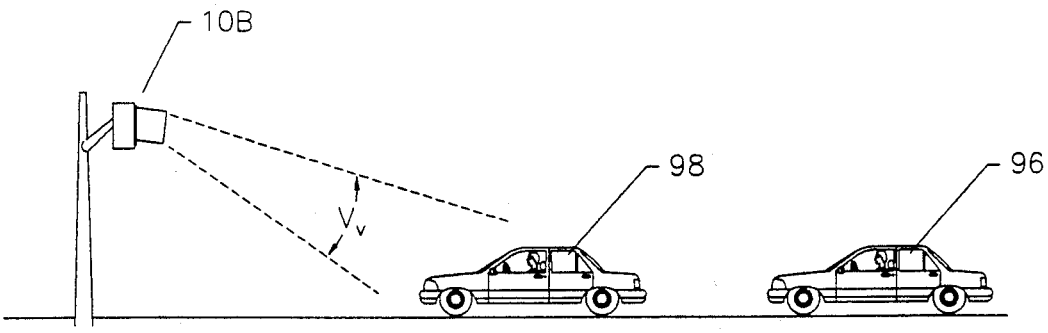
FIG. 16 is a schematic representation of a signal light at an intersection depicting a view range vertically limited to a predetermined distance range from the signal light.

A shown in FIG. 16, a vertical view angle is useful for preventing vehicles from seeing the signal light from beyond a certain distance. For example, this vertical view angle "$V_v$" would prevent motorists in a vehicle 96 in a through lane from seeing the signal 10B so far in advance that they are tempted to speed to "make the light." Yet, vehicles 98 within the predetermined view range could safely view the light 10B.

Returning now to FIG. 14, the positions of the intermediate baffles are selected to create a so-called "tunnel effect". That is, the intermediate baffles 38, 40, 42, 44 and 46 are positioned so that light rays passing through a particular series of apertures in the front and rear baffles 34 and 36 can be seen only through that series or tunnel of apertures and not from an angle outside the predetermined view angle through non-corresponding or non-aligned apertures.

As shown, when viewed directly from in front of an aperture in the front baffle 34, each of the intermediate baffles 38, 40, 42, 44 and 46 obstructs a portion of the light which otherwise would be visible through non-aligned apertures. The position of the intermediate baffles 38, 30, 42, 46 and 48 may be determined according to the following equation:

$$X_i = X_1\left[\frac{a}{b+e}\right]^{i-1}$$

where "X" is the distance from the front baffle 34; where "i" is the number or position of the intermediate baffle, which in the preferred embodiment is 1, 2, 3, 4 or 5; where "a" is the aperture spacing; where "b" is the lateral width of the aperture opening; and where "e" is a selected baffle blockage overlap.

The baffle blockage overlap "e" is included to compensate for minor variations in the size of the apertures and minor misalignment of the baffles, which may occur during manufacture or installation of the device. In the preferred embodiment a baffle blockage overlap value of 0.0227 inches has been selected, as this produces a "w" dimension, previously calculated, of about 4.0 inches.

The distance of the first intermediate baffle 38 from the front baffle 34, or "$X_1$", is computed as follows:

$$X_1 = a\left[\frac{w}{d}\right]$$

where "d" is the inner diameter of the channel 30 of the housing 22.

In the preferred embodiment, the inner diameter of the channel 26 is 10.25 inches ("d"), the aperture spacing is 0.5 inches ("a"), the aperture width is 0.25 inches ("b"), and the selected baffle blockage overlap is 0.0227 inches ("e").

As previously described, when the predetermined view angle is 7 degrees, the distance "w", for purposes of calculating the intermediate baffle positions, is about 4.0. The intermediate baffle positions for this view angle (7 degrees) thus are easily calculated. Likewise alternate baffle arrangements for different view angles can be determined. Baffle positions for view angles of 7 degrees, 8 degrees, 9 degrees, 11 degrees, 13 degrees and 15 degrees are presented in Table I.

TABLE I

| Baffle | Width of Full View Angle | | | | | |
|---|---|---|---|---|---|---|
| Position | 7° | 8° | 9° | 11° | 13° | 15° |
| Front | 0 | 0 | 0 | 0 | 0 | 0 |
| First | 0.194 | 0.194 | 0.194 | 0.194 | 0.194 | 0.194 |
| Second | 0.356 | 0.356 | 0.356 | 0.356 | 0.356 | 0.356 |
| Third | 0.652 | 0.652 | 0.652 | 0.652 | 0.652 | 0.652 |
| Fourth | 1.196 | 1.196 | 1.196 | 1.196 | 1.196 | 1.196 |
| Fifth (rear) | 2.193 | 2.193 | 2.193 | 2.193 | (2.193) | (1.899) |
| Rear | 4.085 | 3.575 | 3.177 | 2.596 | — | — |

As indicated in Table I, where the view angle is 13 degrees or 15 degrees, the distance between the front and rear baffle is decreased to a point that a total of only 6 baffles is required. In these instances, the fifth intermediate baffle is also the rear baffle.

When the baffles are thus configured and positioned, the view range, and particularly the selected view angle, of the light beam from the traffic signal is precisely controlled. A full ball of light is visible from any position in the predetermined area or view range, and a sharp on-off point is provided. No significant glow is perceived due to the fact that the tunnel created by the aligned apertures in the baffles has essentially no wall or other surface in the same plane as the light rays to deflect light rays outside the predetermined view range.

Installation of the device in the visor of a traffic signal is simple. The baffles 32 in the housing 22 are positioned based on a preselected view range, as described previously. The device 20 is positioned in the visor 18 so that the open second end 24 is several inches away from the lens 16. With the traffic light on, the device 20 is rotated in the visor 18 until the selected view range is achieved.

Either before or after the device 20 is positioned in the visor 18, the visor is marked for the placement of screw holes. Because most visor are made of lightweight aluminum, usually it will not be necessary to pre-drill the holes. Thread forming screws may be inserted, preferably with a screw gun, through the visor 18 and into the outer wall of the housing 22. The visor 18 should be relatively snug around the device 20. However, any spaces or irregularities between the outer contour of the housing 22 and the inside of the visor 18 will be occluded by the O-rings 27 and 28.

Figure 17:
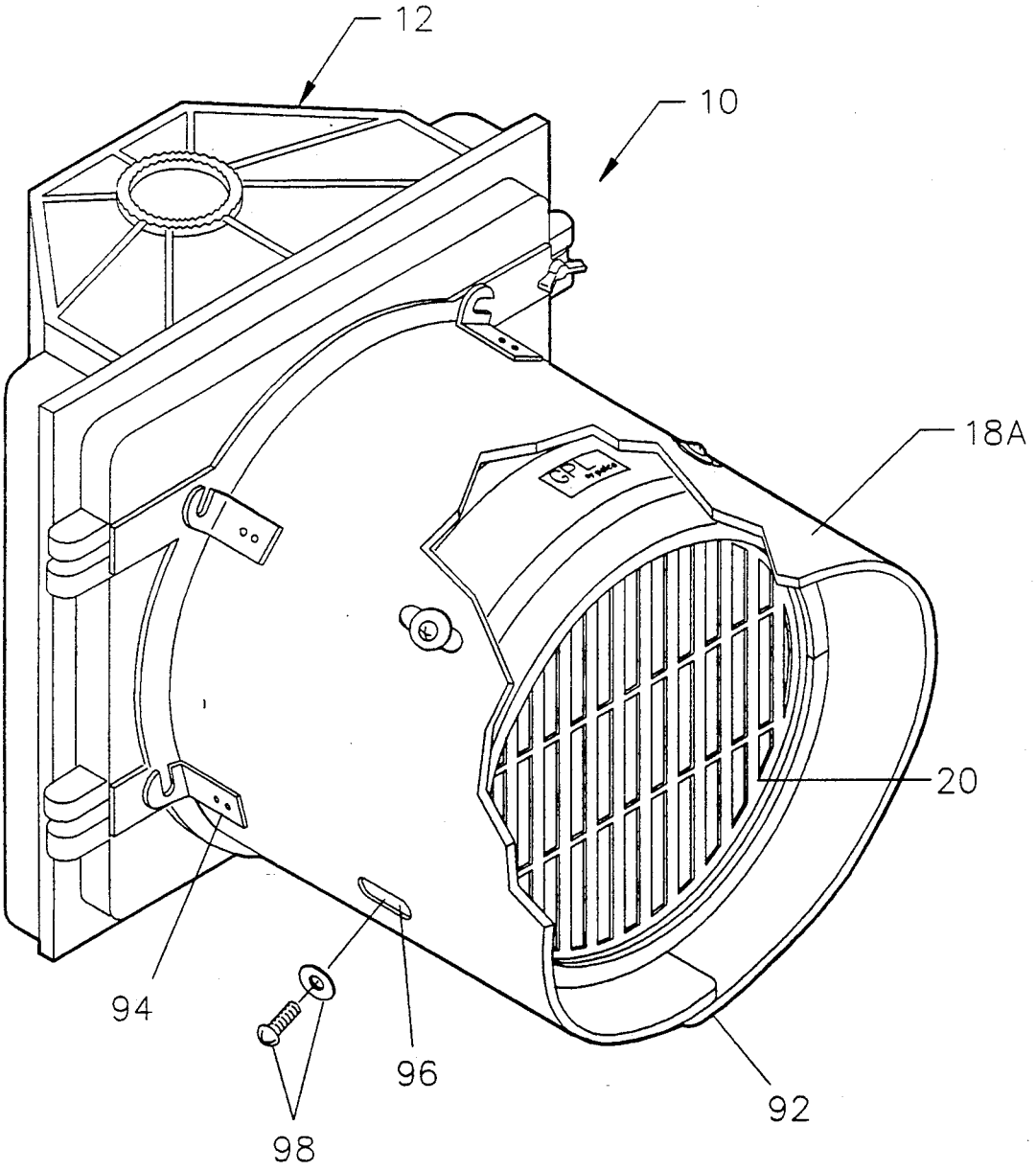
FIG. 17 is an exploded view of the assembly of the present invention showing a replacement visor and a light directing device.

As depicted in FIG. 17, the device 20 may be combined with a replacement visor 18A which is substituted for the original visor 18 (FIG. 1) on the signal head 12. The replacement visor 18A is made of aluminum or some other lightweight, flexible and water resistant material. The visor 18A preferably is formed from a flat sheet of material which is then rolled to overlap slightly. The overlapping portions 92 permit some flexibility in the diameter of the visor, yet completely encircle the installed device 20 to prevent the escape of light from the light source in the signal head 12. The visor 18A is equipped with brackets 94 adapted to fit one of several standard bracket types.

A plurality of slots 96 are pre-drilled in the wall of the visor 18A. Bolts and washers, designated generally by the numeral 98, are included in the assembly for anchoring the device 20 at the selected position in the visor 18A. Thus the need to mark and drill the original visor is eliminated and installation is further simplified.

In using the assembly, the original visor first is removed from the signal head 12. The replacement visor 18A then is attached in its place, and the device 20 is positioned in the visor 18A. The bolts and washers 98 are at least partially inserted. Before tightening the bolts, fine adjustment of the device 20 within the visor 18A may be made.

Now it will be appreciated that the present invention provides a simple and highly effective device for promoting traffic safety by controlling precisely the view range from which the light in a traffic signal can be seen. The device is inexpensive to manufacture and can be made to fit into virtually any existing traffic signal visor or sold as an assembly which includes a replacement visor.

The device has no electrical or moving mechanical parts which require repair or maintenance.

The device is versatile. Due to the spherical housing, the position of the device in the visor may be easily adjusted by multi-directional rotation of the housing within the visor. Thus, a device in accordance with the preferred embodiment of the present invention can be used to create either a horizontal or vertical view angle by simply the rotating the housing in the visor so that the slots are horizontal or vertical, respectively. Then, the device may be tilted in any direction in the visor so that the view range is correctly aimed.

The width of the relevant view angle also can be easily changed by simply repositioning the baffles in the housing. This simplifies manufacturing in that only one product design is required. Moreover, it makes the device more versatile to a customer. Since the devices can be easily installed and removed, one device no longer needed at a particular traffic location can be adjusted and replaced in a second location which requires a different view range.

Changes may be made in the combination and arrangement of the various parts, elements, steps and procedures described herein without departing from the spirit and scope of the invention as defined in the following claims.

What is claimed is:

1. A device for directing a beam of light from a light source, comprising:

a hollow housing having a open first end and an open second end parallel to the first end, wherein the interior of the housing defines a channel between the first end and the second end, and wherein at least a portion of the outer contour of the housing is spherical; and a plurality of spaced apart baffles in the channel of the housing, each baffle comprising an opaque plate with a plurality of apertures, wherein the baffles are positioned parallel to each other and to the first and second ends of the channel, wherein the apertures in the baffles are aligned so as to permit a portion of the light beam from the light source to pass through the channel and whereby the beam of light from the light source is directed to a preselected view range.

2. The device of claim 1 wherein the positions of the baffles in the housing are adjustable.

3. The device of claim 2 wherein the channel of the housing defines a plurality of parallel circumferential grooves, each of which is shaped to receive the peripheral portion of a single baffle.

4. The device of claim 3 wherein each of the baffles is characterized by a front and a rear face and wherein each of the grooves is defined at least in part by a front and a rear surface, the front surface being parallel to the first and second ends of the channel and positioned so as to engage the periphery of the front face of the baffle.

5. The device of claim 1 wherein the apertures in the baffles are slots defined by parallel strips extending substantially the width of the baffle in one direction.

6. The device of claim 5 wherein, in horizontal cross-section, the edges of each strip are substantially pointed.

7. The device of claim 6 wherein, in horizontal cross-section, each strip is V-shaped.

8. The device of claim 5 wherein the baffles are identically formed, wherein the apertures in the baffles all have the same width, and wherein the plurality of baffles comprises:

a rear baffle supported in the housing;

a front baffle supported in the housing, the distance between the front and the rear baffle selected to produce a predetermined view angle; and at least one intermediate baffle supported in the housing between the front baffle and the rear baffle, the position of the intermediate baffle being selected to prevent light which passes through aligned apertures in the front and rear baffles from being seen through non-aligned apertures in the front baffle.

9. The device of claim 8 wherein the width of the all the apertures in the baffles is the same, wherein the distance between the front and the rear baffle is selected according to the equation:

$$\beta = \arctan\left[\frac{b}{w}\right]$$

where "w" is the distance between the front baffle and the rear baffle, where "$\beta$" is one half of the preselected view angle, and where "b" is the width of the apertures in the baffles.

10. The device of claim 9 wherein the strips all have the same width, wherein the device comprises a plurality of intermediate baffles, and wherein the distance of the first intermediate baffle from the front baffle is computed as follows:

$$X_1 = a\left[\frac{w}{d}\right]$$

where "$X_1$" is the distance of the first intermediate baffle from the front baffle, where "a" is the width of the strip between adjacent apertures in the baffles, where "w" is the distance between the front baffle and the rear baffle, and where "d" is the inner diameter of the channel of the housing; and wherein the distance of each intermediate baffle from the front baffle is calculated according to the equation:

$$X_i = X_1\left[\frac{a}{b+e}\right]^{i-1}$$

where "X" is the distance from the front baffle, where "i" is the number of the intermediate baffle counting from the front baffle, where "a" is the distance between apertures, where "b" is the width of the apertures, and where "e" is a selected baffle blockage overlap.

11. The device of claim 10 wherein the plurality of intermediate baffles includes a first, second, third, fourth and fifth intermediate baffle.

12. The device of claim 1 wherein each of the plurality of baffles is identically formed and wherein the plurality of baffles comprises:

a rear baffle supported in the housing;

a front baffle supported in the housing, the distance between the front and the rear baffle selected to produce a predetermined view angle; and at least one intermediate baffle supported in the housing between the front baffle and the rear baffle, the position of the intermediate baffle being selected to prevent light which passes through aligned apertures in the front and rear baffles from being seen through non-aligned apertures in the front baffle.

13. The device of claim 12 comprising a first, second, third, fourth and fifth intermediate baffle, counting from the front baffle.

14. The device of claim 1 wherein the edges of the baffles which define the apertures are substantially pointed.

15. The device of claim 1 wherein the outer surface of the housing defines two circumferential grooves and the device further comprises two rings of resilient material, one ring being seated in each groove.

16. The device of claim 1 wherein the light source is characterized by a visor having an inner wall, wherein the outer surface of the housing of the device defines two circumferential grooves which are parallel to the open first end and to each other, and wherein the device further comprises two rings of resilient material, one seated in each of the grooves in the outer contour of the housing, whereby the resilient rings form a deformable light seal between the inner wall of the visor and the outer contour of the housing.

17. A device for directing a beam of light from a light source, comprising:

a hollow housing having a open first end and an open second end parallel to the first end, wherein the interior of the housing defines a channel between the first end and the second end, wherein the housing is adapted for supporting the device in the path of the beam of light so that a major portion of the light beam is directed into the channel in the housing;

a plurality of baffles removably supported in the housing, each baffle comprising an opaque plate with a plurality of apertures, wherein the baffles are positioned parallel to each other and to the first and second ends of the channel, and wherein the apertures in the baffles are aligned so as to permit a portion of the light beam from the light source to pass through the channel; and means in the housing for supporting baffles in multiple parallel positions throughout the length of the channel, whereby the positions of the baffles in the channel are adjustable.

18. The device of claim 17 wherein the channel of the housing defines a plurality of parallel circumferential grooves, each of which is shaped to receive the peripheral portion of a baffle.

19. The device of claim 18 wherein each of the baffles is characterized by a front and a rear face and wherein each of the grooves is defined at least in part by a front and a rear surface, the front surface being parallel to the first and second ends of the channel and positioned so as to engage the periphery of the front face of the baffle.

20. The device of claim 17 wherein the apertures in the baffles are defined by parallel strips extending substantially the width of the baffle in one direction.

21. The device of claim 20 wherein, in horizontal cross-section, the edges of each strip are substantially pointed.

22. The device of claim 20 wherein, in horizontal cross-section, each strip is T-shaped, the vertical portion of which extends toward the light source.

23. The device of claim 22 wherein the baffles are identically formed, wherein the apertures in the baffles all have the same width, and wherein the plurality of baffles comprises:

a rear baffle supported in the housing;

a front baffle supported in the housing, the distance between the front and the rear baffle selected to produce a predetermined view angle; and at least one intermediate baffle supported in the housing between the front baffle and the rear baffle, the position of the intermediate baffle being selected to prevent light which passes through aligned apertures in the front and rear baffles from being seen through non-aligned apertures in the front baffle.

24. The device of claim 23 wherein the width of the all the apertures in the baffles is the same, wherein the distance between the front and the rear baffle is selected according to the equation:

$$\beta = \arctan\left[\frac{b}{w}\right]$$

where "w" is the distance between the front baffle and the rear baffle, where "$\beta$" is one half of the preselected view angle, and where "b" is the width of the apertures in the baffles.

25. The device of claim 24 wherein the strips all have the same width, wherein the device comprises a plurality of intermediate baffles, wherein the distance of the first intermediate baffle from the front baffle is computed as follows:

$$X_1 = a\left[\frac{w}{d}\right]$$

where "$X_1$" is the distance of the first intermediate baffle from the front baffle, where "a" is the width of the strip between adjacent apertures in the baffles, where "w" is the distance between the front baffle and the rear baffle, and where "d" is the inner diameter of the channel of the housing, and wherein the distance of each intermediate baffle from the front baffle is calculated according to the equation:

$$X_i = X_1\left[\frac{a}{b+e}\right]^{i-1}$$

where "X" is the distance from the front baffle, where "i" is the number of the intermediate baffle counting from the front baffle, where "a" is the distance between apertures, where "b" is the width of the apertures, and where "e" is a selected baffle blockage overlap.

26. The device of claim 25 wherein the plurality of intermediate baffles includes a first, second, third, fourth and fifth intermediate baffle.

27. The device of claim 17 wherein each of the plurality of baffle is identically formed and wherein the plurality of baffles comprises:

a rear baffle supported in the housing;

a front baffle supported in the housing, the distance between the front and the rear baffle selected to produce a predetermined view angle; and at least one intermediate baffle supported in the housing between the front baffle and the rear baffle, the position of the intermediate baffle being selected to prevent light which passes through aligned apertures in the front and rear baffles from being seen through non-aligned apertures in the front baffle.

28. The device of claim 27 comprising five intermediate baffles.

29. The device of claim 17 wherein the edges of the baffles which define the apertures are substantially pointed.

30. The device of claim 17 wherein the light source is characterized by a visor having an inner wall, wherein at least a portion of the outer contour of the housing of the device is spherical, wherein the outer surface of the housing defines two circumferential grooves which are parallel to the first end and to each other, and wherein the device further comprises two rings of resilient material, one seated in each of the grooves in the outer contour of the housing, whereby the resilient rings form a deformable light seal between the inner wall of the visor and the outer contour of the housing.

31. A device for directing a beam of light from a light source, comprising:

a hollow housing having an open first end and an open second end parallel to the first end, wherein the interior of the housing defines a channel between the first end and the second end, and wherein the housing is adapted for supporting the device in the path of the beam of light so that a major portion of the light beam is directed into the channel in the housing; and a plurality of baffles in the channel of the housing, each baffle comprising an opaque plate with a plurality of apertures having equal widths, wherein the baffles are positioned parallel to each other and to the first and second ends of the channel, wherein the apertures in the baffles are aligned so as to permit a portion of the light beam from the light source to pass through the channel, wherein the plurality of baffles includes:

a front baffle supported in the housing;

a rear baffle supported in the housing between the front baffle and the light source, the distance between the front baffle and the rear baffle being selected to produce a predetermined view angle;

wherein the distance between the front and the rear baffle is selected according to the equation:

$$\beta = \arctan\left[\frac{b}{w}\right]$$

wherein "w" is the distance between the front baffle and the rear baffle, where "$\beta$" is one half of the preselected view angle, and where "b" is the width of the apertures in the baffles; and at least a first intermediate baffle supported in the housing between the front baffle and the rear baffle, the position of the intermediate baffle being selected to prevent light which passes through aligned apertures in the front and rear baffles from being seen through non-aligned apertures in the front baffle.

32. The device of claim 31 comprising five intermediate baffles.

33. The device of claim 31 wherein the apertures in the baffles are slots defined by parallel strips extending substantially the width of the baffle in one direction.

34. The device of claim 33 wherein, in horizontal cross-section, the edges of each strip are substantially pointed.

35. The device of claim 34 wherein, in horizontal cross-section, each strip is T-shaped, the vertical portion of which extends toward the light source.

36. The device of claim 31 wherein the strips all have the same width, wherein the device comprises a plurality of intermediate baffles, wherein the distance of the first intermediate baffle from the front baffle is computed as follows:

$$X_1 = a\left[\frac{w}{d}\right]$$

where "$X_1$" is the distance of the first intermediate baffle from the front baffle, where "a" is the width of the strip between adjacent apertures in the baffles, where "w" is the distance between the front baffle and the rear baffle, and where "d" is the inner diameter of the channel of the housing, and wherein the distance of each intermediate baffle from the front baffle is calculated according to the equation:

$$X_i = X_1\left[\frac{a}{b+e}\right]^{i-1}$$

where "X" is the distance from the front baffle, where "i" is the number of the intermediate baffle counting from the front baffle, where "a" is the distance between apertures, where "b" is the width of the apertures, and where "e" is a selected baffle blockage overlap.

37. The device of claim 36 wherein the plurality of intermediate baffles includes a first, second, third, fourth and fifth intermediate baffle.

38. The device of claim 31 wherein the edges of the baffles which define the apertures are substantially pointed.

39. The device of claim 31 wherein the light source is characterized by a visor having an inner wall, wherein at least a portion of the outer contour of the housing of the device is spherical, wherein the outer surface of the housing defines two circumferential grooves which are parallel to the first end and to each other, and wherein the device further comprises two rings of resilient material, one seated in each of the grooves in the outer contour of the housing, whereby the resilient rings form a deformable light seal between the inner wall of the visor and the outer contour of the housing.

40. A device for directing a beam of light from a light source, comprising:

a hollow housing having a open first end and an open second end parallel to the first end, wherein the interior of the housing defines a channel between the first end and the second end, wherein at least a portion of the outer contour of the housing is spherical, wherein the outer surface of the housing defines two circumferential grooves which are parallel to the open first end and to each other;

two rings of resilient material, one seated in each of the grooves in the outer contour of the housing;

a plurality of baffles removably supported in the channel of the housing, each baffle comprising an opaque plate with a plurality of apertures, wherein the baffles are positioned parallel to each other and to the first open end of the channel, wherein the apertures in the baffles are aligned so as to permit a portion of the light beam from the light source to pass through the channel, wherein the plurality of baffles includes:

a front baffle supported in the housing;

a rear baffle supported in the housing between the front baffle and the light source, the distance between the front baffle and the rear baffle being selected to produce a predetermined view angle; and at least a first intermediate baffle supported in the housing between the front baffle and the rear baffle, the position of the intermediate baffle being selected to prevent light which passes through aligned apertures in the front and rear baffles from being seen through non-aligned apertures in the front baffle; and means in the housing for supporting baffles in multiple parallel positions throughout the length of the channel, whereby the positions of the baffles in the channel are adjustable.

41. An assembly for directing a beam of light from a light source, comprising:

a visor sized for capturing the light beam from the light source;

means for attaching the visor adjacent the light source;

a device as recited in claim 1, 17, 31, 40, which device is sized to be received in the visor; and means for securing the device inside the visor in a selected position.

42. A traffic signal comprising:

a signal head;

a light source mounted in the signal head;

a visor on the signal head extending from the light source; and a device for directing the beam of light from the light source, as recited in claim 1, 16, 29 or 38.

43. A device for directing a beam of light from a light source, comprising:

a hollow housing having an open first ned and an open second end parallel to the first end, wherein the interior of the housing defines a channel between the first end and the second end, and wherein the housing is adapted for supporting the device in the path of the beam of light so that a major portion of the light beam is directed into the channel in the housing; and a plurality of baffles in the channel of the housing, each baffle comprising an opaque plate with a plurality of apertures defined by strips having equal widths, wherein the baffles are positioned parallel to each other and to the first and second ends of the channel, wherein the apertures in the baffles are aligned so as to permit a portion of the light beam from the light source to pass through the channel, wherein the plurality of baffles includes:

a front baffle supported in the housing;

a rear baffle supported in the housing between the front baffle and the light source, the distance between the front baffle and the rear baffle being selected to produce a predetermined view angle; and at least a first intermediate baffle supported in the housing between the front baffle and the rear baffle, the position of the intermediate baffle being selected to prevent light which passes through aligned apertures in the front and rear baffles from being seen through non-aligned apertures in the front baffle; and wherein the distance of the first intermediate baffle from the front baffle is computed as follows:

$$X_1 = a\left[\frac{w}{d}\right]$$

wherein "$X_1$" is the distance of the first intermediate baffle from the front baffle, where "a" is the width of the strip between adjacent apertures in the baffles, where "w" is the distance between the front baffle and the rear baffle, and where "d" is the inner diameter of the channel of the housing, and wherein the distance of each intermediate baffle from the front baffle is calculated according to the equation:

$$X_i = X_1\left[\frac{a}{b+e}\right]^{i-1}$$

where "X" is the distance from the front baffle, where "i" is the number of the intermediate baffle counting from the front baffle, where "a" is the distance between apertures, where "b" is the width of the apertures, and where "e" is a selected baffle blockage overlap.

44. The device of claim 43 comprising five intermediate baffles.

45. The device of claim 43 wherein the apertures in the baffles are slots defined by parallel strips extending substantially the width of the baffle in one direction.

46. The device of claim 45 wherein the distance between the front and the rear baffle is selected according to the equation:

$$\beta = \arctan\left[\frac{b}{w}\right]$$

where "w" is the distance between the front baffle and the rear baffle, where "$\beta$" is one half of the preselected view angle, and where "b" is the width of the apertures in the baffles.

47. The device of claim 46 wherein the plurality of intermediate baffles includes a first, second, third, fourth and fifth intermediate baffle.

48. The device of claim 45 wherein, in horizontal cross-section, the edges of each strip are substantially pointed.

49. The device of claim 48 wherein, in horizontal cross-section, each strip is T-shaped, the vertical portion of which extends toward the light source.

50. The device of claim 43 wherein the edges of the baffles which define the apertures are substantially pointed.

* * * * *

UNITED STATES PATENT AND TRADEMARK OFFICE

CERTIFICATE OF CORRECTION

PATENT NO. : 5,299,111

DATED : March 29, 1994

INVENTOR(S) : Parduhn et al.

It is certified that error appears in the above-identified patent and that said Letters Patent is hereby corrected as shown below:

Column 1, line 17, the words "a open" should be -- an open --.

Column 1, line 33, the words "a open" should be -- an open --.

Column 1, line 51, before the word "present" insert the word -- the --.

Column 1, line 53, the words "a open" should be -- an open --.

Column 1, line 66, please insert a period after the word "channel".

Column 2, line 13, the words "a open" should be -- an open --.

Column 2, line 65, after the word "is" insert the word -- a --.

Column 6, line 60, after the word "seen" insert the word -- in --.

Column 8, line 57, the numbers "38, 30, 42, 46 and 48" should be -- 38, 40, 42, 44 and 46 --.

Column 10, line 1, the word "visor" should be -- visors --.

UNITED STATES PATENT AND TRADEMARK OFFICE

CERTIFICATE OF CORRECTION

PATENT NO. : 5,299,111

DATED : March 29, 1994

INVENTOR(S) : Parduhn et al.

It is certified that error appears in the above-identified patent and that said Letters Patent is hereby corrected as shown below:

Column 10, line 52, after the word "simply" please delete the word "the."

Column 11, line 6, the words "a open" should be -- an open --.

Column 11, line 55, before the word "all" please delete the word "the."

Column 13, line 1, the words "a open" should be -- an open --.

Column 13, line 37, the number "20" should be -- 21 --.

Column 13, line 54, after the word "of" please delete the word "the."

Column 14, line 32, the word "baffle" should be -- baffles --.

Column 16, line 31, the words "a open" should be -- an open --.

Column 17, line 17, the numbers "17, 29 or 38" should be -- 17, 31 or 40 --.

UNITED STATES PATENT AND TRADEMARK OFFICE

CERTIFICATE OF CORRECTION

PATENT NO. : 5,299,111
DATED : March 29, 1994
INVENTOR(S) : Parduhn et al.

It is certified that error appears in the above-indentified patent and that said Letters Patent is hereby corrected as shown below:

Column 17, line 20, the word "ned" should be --end--.

Signed and Sealed this

Twenty-second Day of November, 1994

*Attest:*

Bruce Lehman

BRUCE LEHMAN

*Attesting Officer*

*Commissioner of Patents and Trademarks*